United States Patent [19]

Watanabe

[11] Patent Number: 5,029,560

[45] **Date of Patent: * Jul. 9, 1991**

[54] OIL PRESSURE LASH ADJUSTER OF A DIRECTLY ACTING TYPE

[75] Inventor: Akira Watanabe, Tokyo, Japan

[73] Assignee: Nittan Valve Co., Ltd., Tokyo, Japan

[ * ] Notice: The portion of the term of this patent subsequent to Feb. 12, 2008 has been disclaimed.

[21] Appl. No.: 531,030

[22] Filed: May 31, 1990

[30] Foreign Application Priority Data

Jun. 2, 1989 [JP] Japan ..... 1-139325

[51] Int. Cl.[5] ..... F01L 1/24

[52] U.S. Cl. ..... 123/90.55; 123/90.37; 74/569

[58] Field of Search ..... 123/90.33, 90.37, 90.55; 74/569

[56] References Cited

U.S. PATENT DOCUMENTS

| | | | |
|---|---|---|---|
| 4,392,462 | 7/1983 | Lesher | 123/90.55 |
| 4,465,038 | 8/1984 | Speil | 123/90.55 |
| 4,579,094 | 4/1986 | Doppling et al. | 123/90.55 |
| 4,590,898 | 5/1986 | Buente et al. | 123/90.55 |
| 4,694,790 | 9/1987 | Kowal | 123/90.55 |
| 4,715,334 | 12/1987 | Buente et al. | 123/90.55 |
| 4,745,889 | 5/1988 | Speil | 123/90.55 |
| 4,787,347 | 11/1988 | Schaeffler | 123/90.55 |
| 4,867,114 | 9/1989 | Schaeffler | 123/90.55 |

*Primary Examiner*—David A. Okonsky
*Assistant Examiner*—Weilun Lo
*Attorney, Agent, or Firm*—Michael J. Striker

[57] ABSTRACT

A directly acting lush adjuster includes an oil pressure unit located in the adjuster housing and forming a main reservoir. The housing forms a sub-reservoir surrounding said oil pressure unit. To prevent oil leakage, a sealing device is provided between an outer circumference of the oil pressure unit and a partitioning wall of the housing that forms a sub-reservoir.

1 Claim, 5 Drawing Sheets

OIL PRESSURE LASH ADJUSTER OF A DIRECTLY ACTING TYPE

FIELD OF THE INVENTION

This invention relates to an improvement of an oil pressure lash adjuster of a directly acting type which is incorporated with an oil pressure unit within a bucket.

A "bottomed" condition herein refers to a condition when an oil pressure unit is pressed to a maximum by a cam nose as seen in FIGS. 2 or 8.

BACKGROUND OF THE INVENTION

A valve actuating mechanism used in an internal combustion engine is influenced by wear or thermal expansions, whereby a space or a clearance formed at the valve is deformed during operations and adversely affects the output and results in an undesirable noise. An oil pressure lash adjuster has been therefore used to rectify the deformed space or clearance.

A directly actuating valve mechanism has been designed to be light in weight for a cam to directly strike an end of a valve shaft this mechanism has been also employed with the oil pressure, lash adjuster as shown in FIG. 7.

The oil pressure lash adjuster includes a housing and an oil pressure unit Y of the lash adjuster located therewithin, and is placed between a cam 300 and the end of a shaft 400.

The oil pressure unit Y is slidably mounted on the outer circumference of a plunger 101 shaped as a cylinder having an oil orifice 104 in its bottom. The unity Y comprises a cylinder-shaped body 100 of defining a high pressure chamber 102 at with the bottom of the body 100; an elastic member 105 provided in the high pressure chamber 102 and biasing the body 100 downward; a check valve 106 disposed in the high pressure chamber for opening and closing the oil orifice 104; and a valve spring 107 supporting the check valve 106 and a check valve cage 108 in the high pressure chamber 102.

The oil pressure unit Y is located in the housing X, defining a main reservoir 103 as an oil storage between the rear surface of a face disc 202 and the hollow portion of the plunger 101 as well as a sub-reservoir 200 communicating, via an overflow recess 203, with the main reservoir 103 partitioned with the circumferential wall of the plunger 101, the sub-reservoir 200 being supplied with the actuating oil through an oil feed orifice 500 of a cylinder head and an oil orifice 510 of the housing X.

On the other hand, a cam 300 contacts the face disc 202 of the housing X, while the end of the valve shaft 400 contacts the closed face of the body 100, so that the cam 300 strikes the end of the valve shaft 400 via the oil pressure lash adjuster.

The oil pressure lash adjuster makes use of a incompressibility of the actuating oil when applying pressure to the actuating oil filling in the high pressure chamber 102, and an expansion property of the elastic member 105 which expands in the chamber when releasing the pressure so as to bring the space to be zero which space has been thermally deformed in the valve actuating mechanism.

A part of the oil to be supplied to the sub-reservoir 200 leaks via a space between the outer circumference of the oil pressure unit Y (the outer circumference of the body 100 in the drawing) and the sleeve 201 forming a partition of the sub-reservoir 200.

When the internal combustion engine stops while a cam nose 301 keeps pressing the face disc 202 of the housing X, the oil pressure unit Y is compressed as shown in FIG. 8, that is, it is in its most shortened (bottom condition). If the engine restarts under this condition, the sliding stroke between the plunger 101 and the body 100 is maximum, and the oil is most absorbed into the high pressure chamber 102. But if the oil leaks as mentioned above when the engine stops, the oil is not supplied thereinto from a cylinder head, and accordingly the oil is not supplied enough into the main reservoir 103 from the sub-reservoir 200. Therefore, when restarting the internal combustion engine, an air is absorbed together with the actuating oil, into the high pressure chamber 102 and the incompressibility of the actuating oil in the chamber 102 when the plunger 101 is pressed, is considerably lost (the incompressibility becomes soft and called as "sponge" condition) so that the space of the valve cannot be rectified.

SUMMARY OF THE INVENTION

In view of the above stated problems of the prior art, the present invention has been devised, and it is an object of the invention to provide a structure which can prevent the leakage of the oil from the reservoirs when the oil pressure unit is bottomed while the engine is at rest.

This invention is characterized by providing a sealing device on the outer circumference of the oil pressure unit (a position corresponding to the outer circumference of the body 100 in the above mentioned example), or providing the sealing device between the outer circumference of the oil pressure unit and a partition wall of the sub-reservoir surrounding said outer circumference.

When the oil pressure unit is bottomed when it stands vertically or almost vertically, or tilted as seen in FIG. 8, or lies horizontally or almost horizontally, and the engine stops, the sealing device serves to prevent the leakages from the main and sub-reservoirs. Thus the oil amount within the main reservoir is kept sufficient thereby, and although the oil is not supplied from the cylinder head, the high pressure chamber is supplied with the actuating oil when restarting the engine, and the air is not absorbed.

The present invention both as to its construction so to its mode of operation, together with additional objects and advantages thereof, will be best understood from the following detailed description of the preferred embodiment when read in connection with the accompanying drawings.

DETAILED DESCRIPTION OF THE PREFERRED EMBODIMENTS

Figure 1:
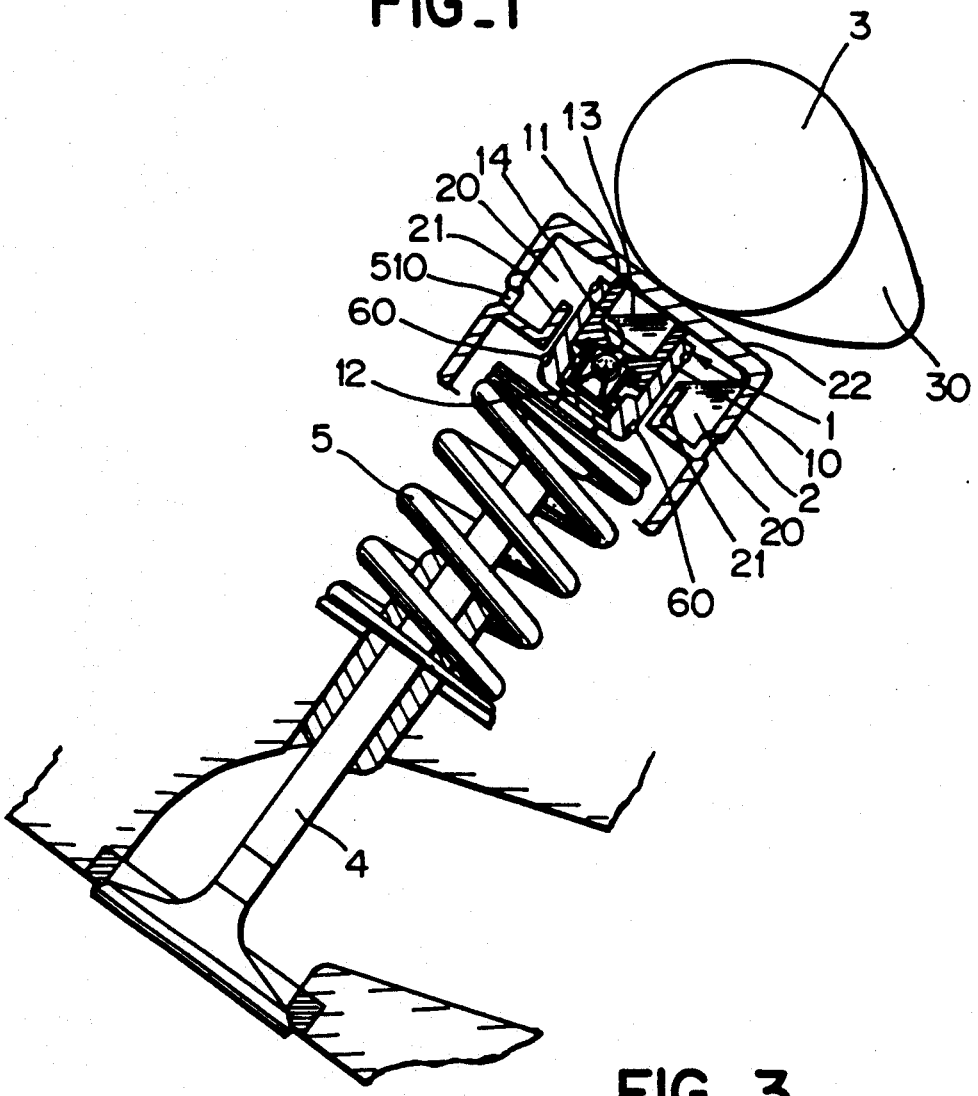
FIG. 1 is a cross sectional view of a lash adjuster according to the invention is used in a actuating mechanism of a directly actuating type.
Figure 3:
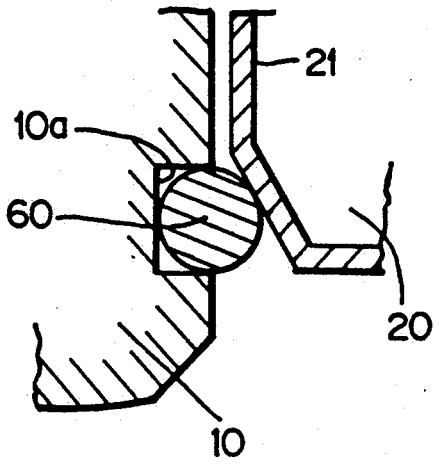
FIG. 3 is a cross-sectional view along line A—A of FIG. 2.
Figure 2:
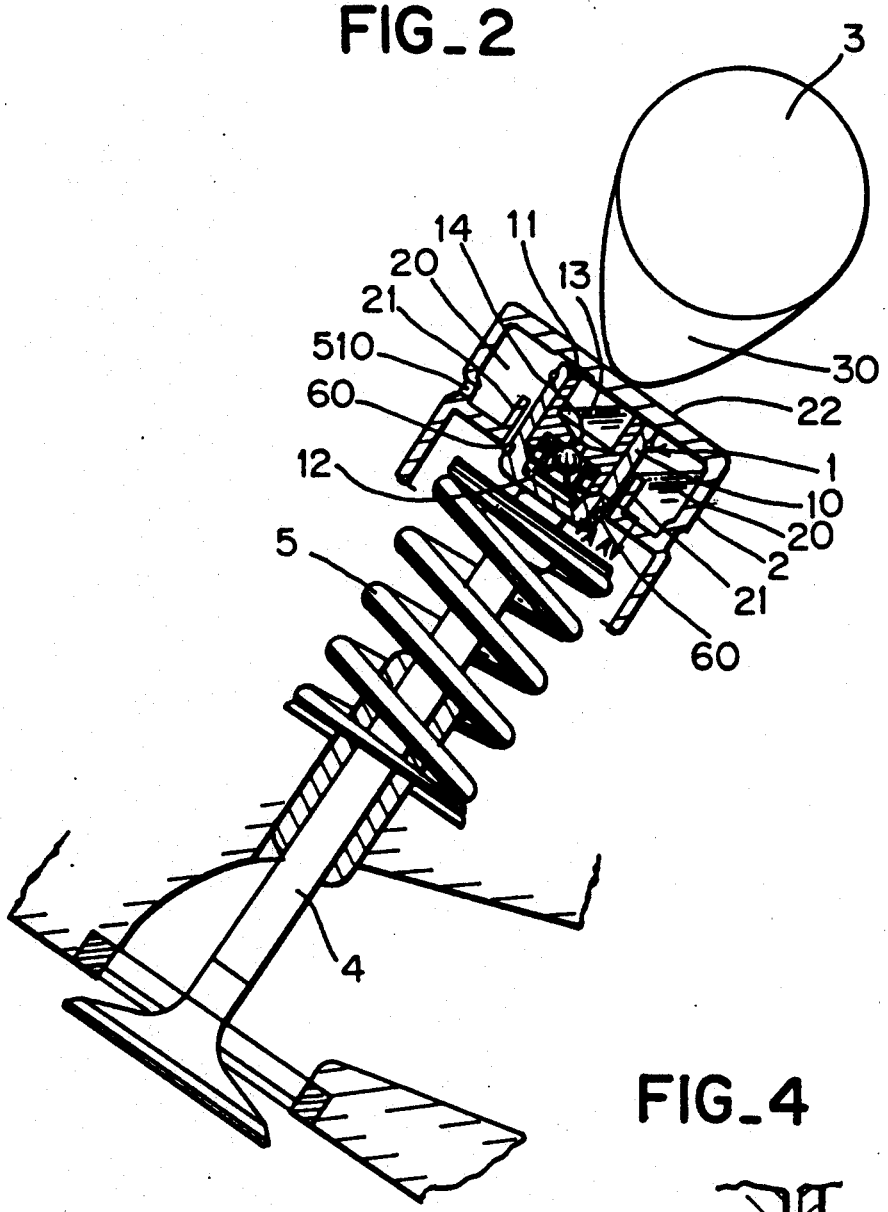
FIG. 2 is a view showing a bottomed condition of the oil pressure unit of the lush adjuster when a cam nose is stopped.

FIGS. 1 to 3 of the drawings show one example of the invention.

In the drawings, the reference numeral 1 is an oil pressure unit; 10 is a body forming a part of the unit 1; 11 is a plunger also forming a part of the unit 1; 12 is a high pressure chamber defined between the body 10 and the plunger 11; 13 is a main reservoir defined in the plunger 11; 14 is an oil orifice communicating between the high pressure chamber 12 and the main reservoir 13; 2 is a housing; 20 is a sub-reservoir defined with a partitioning wall furnished within the housing 2; 3 is a cam; 4 is a valve; and 5 is a valve spring.

As it is shown in FIG. 3 which represents a cross-section along the line A—A of FIG. 2, in the present example, a recess 10*a* is formed at the lower end of the outer circumference of the body 10, in which an O ring 60 is fitted which sealing means of this invention.

When the oil pressure unit 1 is almost bottomed, the O ring 60 contacts the partitioning wall 21 of the sub-reservoir 20, and closes the space between the partitioning wall 21 and the outer circumference of the body 10 and check the oil leakage from the sub-reservoir 20. Therefore, if the engine stops while a nose 30 of the cam 3 presses the face disc 22 of the housing 2, that is, while the oil pressure unit 1 is bottomed, the sufficient oil amount may be kept within the main reservoir 13, and the air is prevented from entering the high pressure chamber 12 when re-starting the internal combustion engine.

On the other hand, while the engine operates, the actuating oil is supplied to the sub-reservoir 20 from the cylinder head through and oil field orifice and no problem arises with respect to the oil amounts of the reservoirs 13, 20.

When the engine stops while the cam 3 stands at its circle of the base as seen in FIG. 1 and since the oil pressure unit 1 is not bottomed, the oil leaks more or less due to absence of the sealing effect. However the oil little goes into the high pressure chamber 12 when restarting the engine, and the air is not absorbed thereinto.

By providing the the O ring 60 between the outer circumference of the body 10 and the partitioning wall 21 of the sub-reservoir 20, the actuating oils stored in the main reservoir 13 and the sub-reservoir 20 do not go to the cylinder head from the oil reference 510 of the housing 2 (this is the same when the entire actuating valve mechanism is tilted reversely to FIG. 2 and the oil orifice faces downward).

In the present example, since the partitioning wall 21 of the sub-reservoir 20 tapes at the lower side thereof as shown in FIG. 3, the O-ring 60 is checked from the wearing while an exact sealing is possible.

Figure 4:
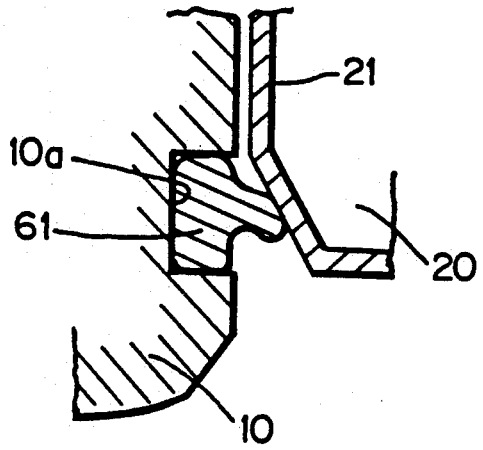
FIG. 4 is a cross-sectional view similar to that of FIG. 2 of another embodiment of the lash adjuster.
Figure 5A:
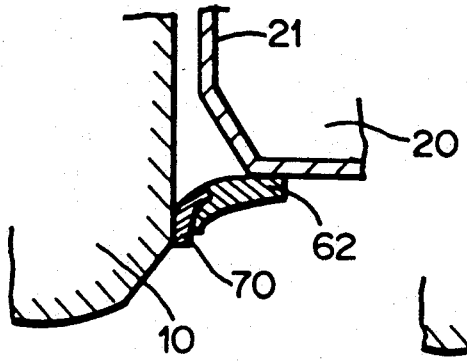
FIGS. 5(*a*) (*b*) (*c*) (*d*) (*e*) are cross-sectional views showing the same cross-section as FIGS. 3 and 4 of different lush adjusters.
Figure 5B:
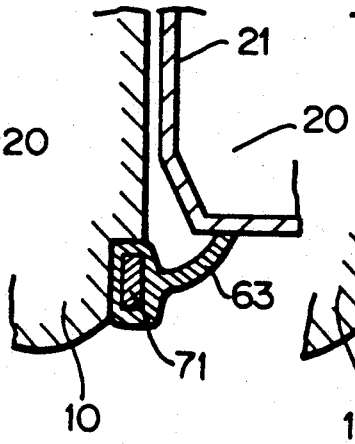
Figure 5C:
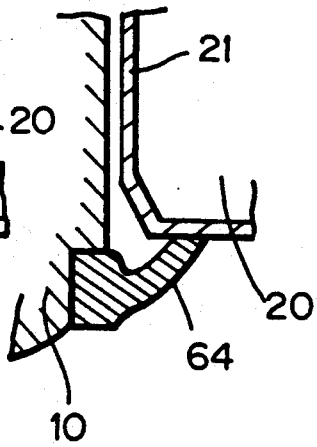
Figure 5D:
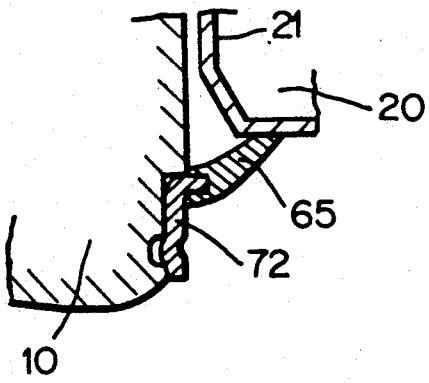
Figure 5E:
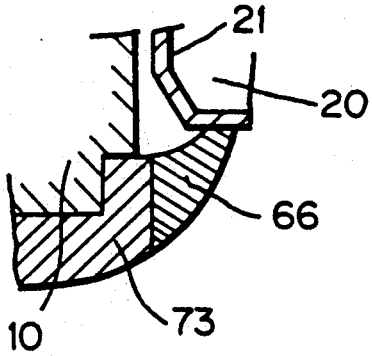

With other embodiments, FIG. 4 shows a modified ring 61 instead of the O ring 60; FIGS. 5(*a*) to (*e*) show that sealing materials 62 to 66 are directly fixed to the lower side of the outer circumstance of the body 10, or via back metals 70 to 72 or a patch 73; and FIG. 6 shows that a sealing material 67 is attached to the lower end of the partitioning wall 21 of the sub-reservoir 20 while the lower part of the body 10 is projected with a material 68.

Figure 6:
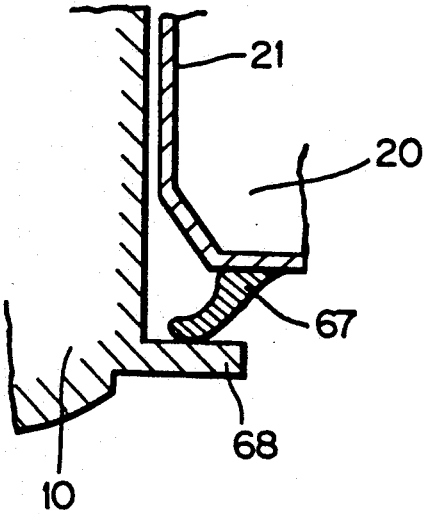
FIG. 6 is yet another cross-sectional view similar to FIGS. 3–5.
Figure 7:
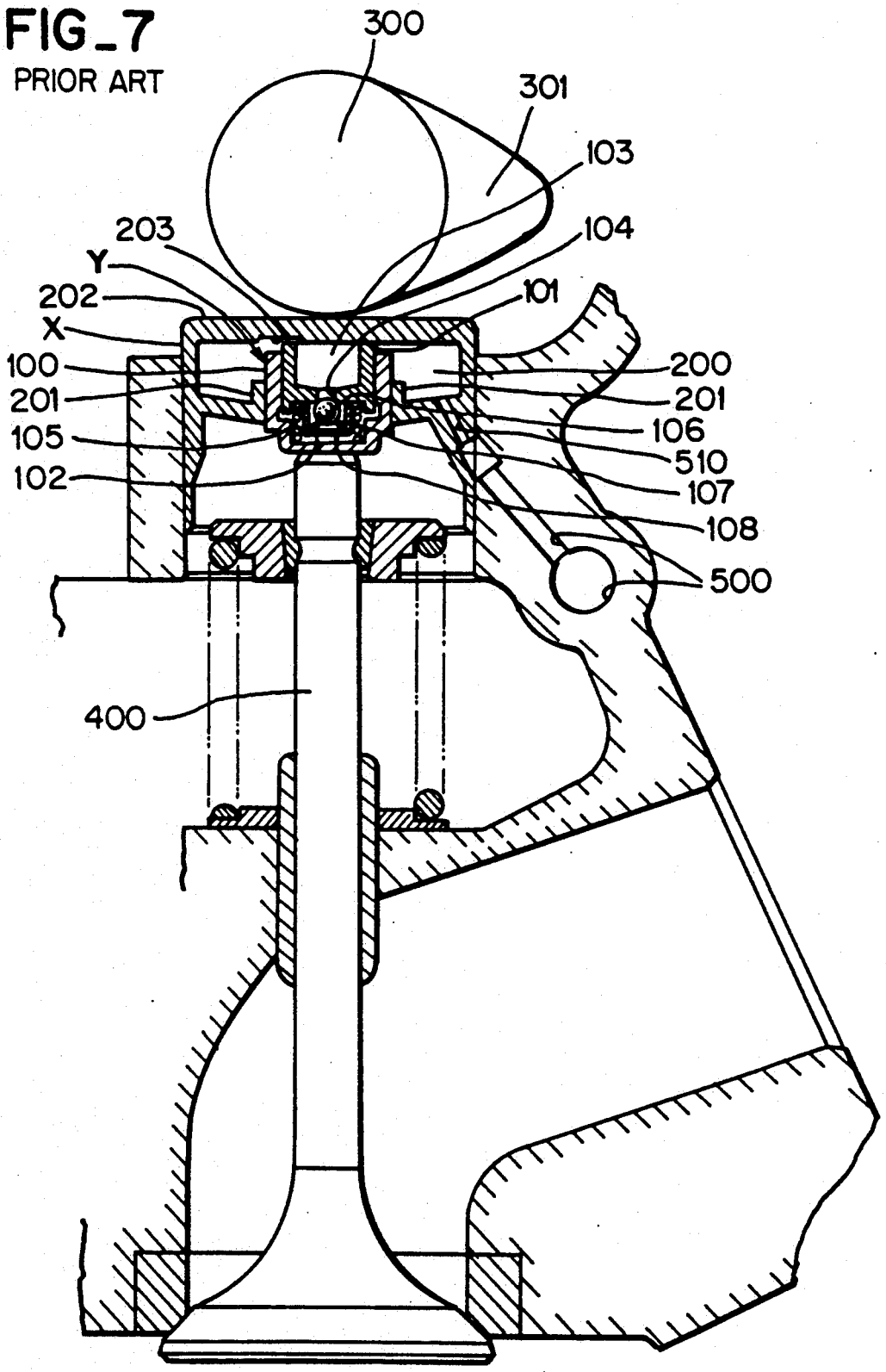
FIG 7 PRIOR ART
FIG. 7 is a cross-sectional view showing a conventional valve acting mechanism of a directly actuating type.
Figure 8:
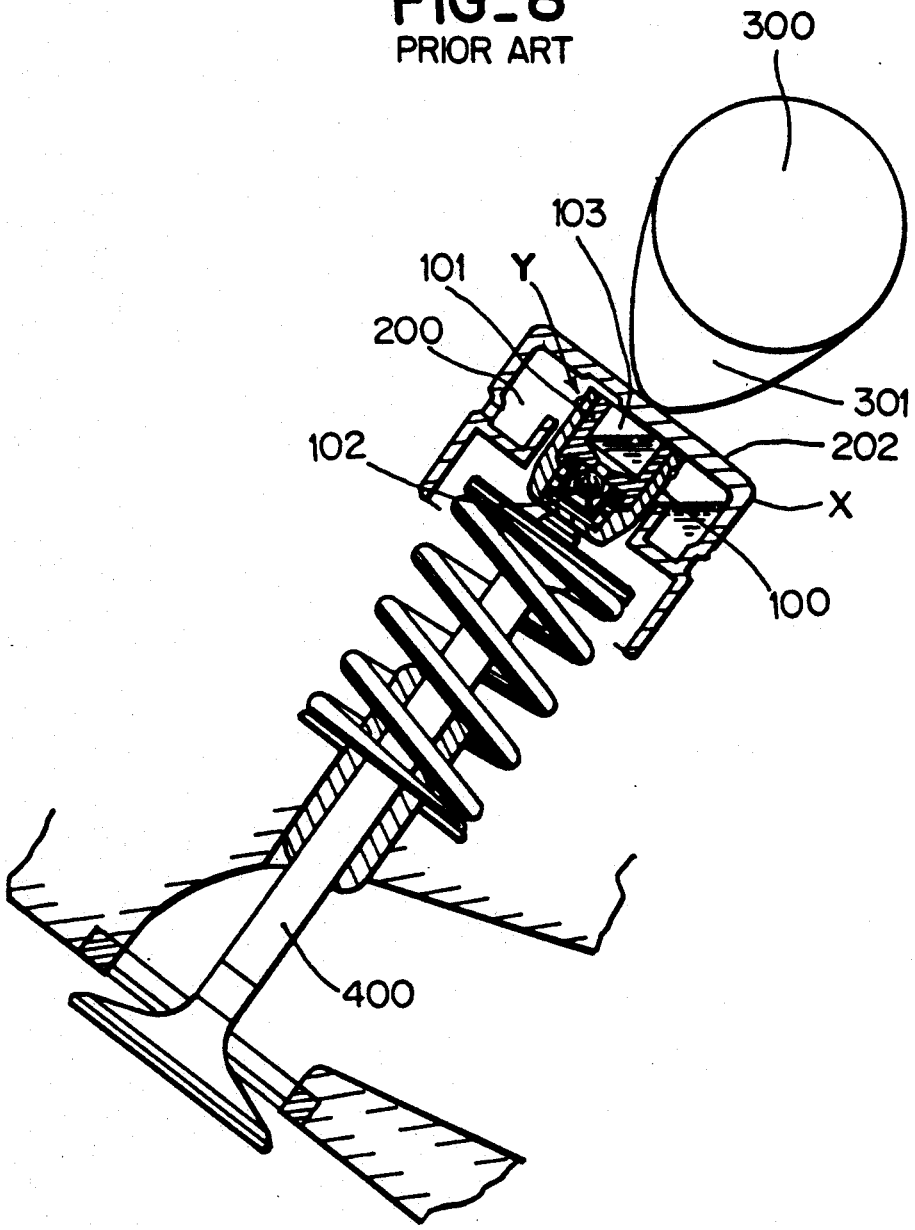
FIG 8 PRIOR ART
FIG. 8 is an explanatory view showing the bottomed condition of the oil pressure unit when the cam nose is stopped in the conventional valve acting mechanism.

In these embodiments, the modified ring 61 and the sealing materials 62 to 66 are used in the invention, and in FIG. 6, the sealing material 67 and the projected material 68 both serve as sealing devices.

The oil pressure lash adjuster is in general supplied with the actuating oil mix with air, and this air is purged from the clearance between the outer circumference of the body 10 and the partitioning wall 21 of the sub-reservoir 21, and in each of the above mentioned examples, the air purging effect is secured.

According to the invention, when the oil pressure unit is bottomed and the engine is stopped, the sealing device checks the oil leakage from the clearance between the outer circumference of the unit and the partitioning wall of the sub-reservoir, so that the oil amount is kept full in the both reservoirs, and the air is checked from entering the high pressure chamber.

While the invention has been illustrated and described as embodied in a lush adjuster, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A directly acting lash adjuster comprising a housing; an oil pressure unit located in said housing and including a main reservoir, said housing defining a sub-reservoir surrounding said oil pressure unit for supplying oil to said main reservoir; and sealing means providing on an outer circumference of said oil pressure unit for preventing leakage from said main-and sub-reservoirs when the oil pressure unit is almost bottomed, said housing having a partitioning wall forming said sub-reservoir and surrounding said oil pressure unit, said sealing means being located between the outer circumference of said oil pressure unit and said partitioning wall.

* * * * *